US006527676B1

(12) United States Patent
Frick et al.

(10) Patent No.: US 6,527,676 B1
(45) Date of Patent: Mar. 4, 2003

(54) FITNESS APPARATUS

(76) Inventors: Moritz Frick, Husarenstrasse 34, D-38102 Braunschweig (DE); Andreas Dittmar, Husarenstrasse 34, D-38102 Braunschweig (DE)

( * ) Notice: Subject to any disclaimer, the term of this patent is extended or adjusted under 35 U.S.C. 154(b) by 0 days.

(21) Appl. No.: 09/744,037

(22) PCT Filed: May 22, 1999

(86) PCT No.: PCT/EP99/03538

§ 371 (c)(1),
(2), (4) Date: Mar. 12, 2001

(87) PCT Pub. No.: WO00/03770

PCT Pub. Date: Jan. 27, 2000

(30) Foreign Application Priority Data

Jul. 17, 1998 (DE) ..... 198 32 235

(51) Int. Cl.[7] ..... A63B 21/00
(52) U.S. Cl. ..... 482/51; 482/66; 482/70
(58) Field of Search ..... 482/51, 54, 66–72

(56) References Cited

U.S. PATENT DOCUMENTS 6,183,398 B1 * 2/2001 Rufino et al. ..... 482/70
6,340,340 B1 * 1/2002 Stearns et al. ..... 482/70
6,461,280 B1 * 10/2002 Benedicker ..... 482/70

* cited by examiner

*Primary Examiner*—Glenn E. Richman
(74) *Attorney, Agent, or Firm*—Bachman & LaPointe, P.C.

(57) ABSTRACT

In a fitness machine with a carriage (2) which is mounted in a movable manner on a carrier element (1) and is intended for at least one person, the carriage (2) can be made to move in a reciprocating manner on the carrier element (1) by means of at least one actuating element (7.1, 7.2).

15 Claims, 4 Drawing Sheets

FITNESS APPARATUS

The present invention relates to a fitness machine with a carriage which is mounted in a movable manner on a carrier element, is intended for at least one person and has at least one actuating element and energy-store elements.

Such fitness machines are known and available commercially in a wide range of different forms and design.

Known, for example, is a rowing machine or the like by means of which a carriage can be displaced in relation to a rail during a rowing movement. In this case, the carriage can be moved in relation to a mounting arrangement for feet, or the feet element of the same, and is arranged on a carrier element.

Instead of individual actuating elements, it is possible, in the fitness machines known in the prior art, for a force-activated spring element or a chain-operated flywheel to be driven in order to produce a rowing force.

U.S. Pat. No. 5,279,532 discloses a fitness machine in which two carriages are arranged in a movable manner on a carrier. Said carriages are each connected to an elastic band connected to those. The two carriages may be deflected by means of a foot. This deflection causes the elastic band to be subjected to stressing and requires a certain application of force.

U.S. Pat. No. 5,066,005 discloses a fitness machine, a carriage being arranged in a movable manner on a carrier. At one end the carriage is connected to a spring element and at the other end it is connected via a non-elastic retaining cable, which is guided from an end-side carrier, via a deflecting roller, back to the carriage. By virtue of the retaining cable being pulled, the carriage can be moved in the direction of the end position, and at the same time, by virtue of this movement, the elastic bands are subjected to stressing at the other end. By virtue of the retaining cable being released, the carriage moves back again into its end position.

U.S. Pat. No. 5,752,879 describes a fitness machine in which a carriage can be moved back and forth in relation to a carrier element which can be adjusted about a bearing means. In particular by virtue of the carrier element being pivoted about the bearing means, it is possible to adjust the angled position, with the result that a user has to move the carriage, for example, in the upward direction back and forth about a rest position. The steeper the angle at which the carrier is set, the greater is the force, via the user's dead weight, which has to be applied in order to move the carriage upward.

U.S. Pat. No. 1,982,872 describes a fitness machine with a framework which can be adjusted upward in an inclined manner in relation to an underlying surface. A carriage is mounted in a movable manner along said framework. By means of a cable, a user can move the carriage out of a rest position into an elevated end position and, by virtue of the cable being released, the carriage automatically slides back again into its starting position with the user.

FR 2 245 332 describes a fitness apparatus, in particular a rowing machine, in which a carriage is provided for moving the feet back and forth.

The object of the present invention is to provide a fitness machine of the above-mentioned type which can be used universally and by means of which a number of different movements and, if appropriate, accelerations are possible.

This object is achieved in that, by virtue of at least one energy-store element being subjected to the action of the actuating element arranged on the carriage, the carriage can be accelerated into a reciprocating movement, caused by the energy-store element about its rest position.

The carriage, with a mounting arrangement for feet and a seat element, which is arranged such that it can be displaced, if appropriate, on the carriage, can be moved back and forth out of a preferably central rest position by actuation of the actuating element. The actuating element is coupled to a force-transmitting element via tie elements. Two tie elements are preferably provided in this case, these being deflected on the carriage and engaging in a force-transmitting element. The force-transmitting element is secured on at least one energy-store element.

In the preferred exemplary embodiment of the invention, the energy-store element is formed as a rubber element, in particular from a plurality of rubber elements which, on the end sides, engage, via deflecting elements, in a corresponding guide rail, run through the latter and are secured at the other end.

The energy-store elements are prestressed correspondingly in this rest position.

By virtue of the actuating element being moved, on account of the inertia of the dead weight of the carriage and of the body weight, one energy-store element on one side of the force-transmitting element is subjected to stressing and the other energy-store element, on the opposite side of the force-transmitting element, is relieved of stressing. This results in a force counter to a direction of travel. The carriage is moved counter to a direction of travel.

Subsequent movement of the actuating element back causes, in the reverse direction, the energy-store element to be correspondingly subjected to pressure, with the result that the carriage is accelerated in the direction of travel.

By virtue of the actuating element being correspondingly moved back and forth, one of the two energy-store elements is expanded or relieved of loading. As a result, the entire carriage, with the mounting arrangement and the seat element, can be moved back and forth about a rest position, accelerated and, in particular, made to move in reciprocating manner.

The greater the deflection about a rest position, the greater is the speed and the acceleration by which the carriage can be made to move in a reciprocating manner through the rest position.

If, for example, an end position is reached, then one of the two energy-store elements is relieved of loading and the other is fully subjected to loading. In this way, with a carrier element of preferably long design, it is possible for very high speeds and large deflections to take place about a rest position.

Instead of the energy-store elements designed as rubber elements, it is also possible here to provide spring elements, weights or the like.

It is also intended to lie within the scope of the idea of the present invention that, for example, the mounting arrangement can be moved in relation to the then fixed seat element and, as a result, a reciprocating movement, in particular stressing and expanding of the energy-store elements, can take place via the force-transmitting element. It is then possible for the actuating element to be dispensed with or provided in addition.

It is also intended to lie within the scope of the present invention that, for example, the person or persons on the carriage can be accelerated back and forth about a rest position by actuation of corresponding actuating elements.

Furthermore, it is also intended to exchange the corresponding energy-store elements, to replace them by energy-store elements of larger or smaller dimensions or even to influence the prestressing in order to have an effect, for example, on the different forces which have to be applied in order to make the carriage and a person move in a reciprocating manner.

It is likewise intended to lie within the scope of the present invention that it is not just the linear movement of the carriage on the carrier element which is possible, but that the carrier element may be designed in a circular, semicircular or undulating manner in order that a carriage can be made to reciprocate back and forth along this contour. It is further conceivable for the carrier element to be designed such that it is inclined or even steeply inclined, if appropriate even up to a vertical position, in relation to an underlying surface, in order also to allow an acceleration, for example, in the upward direction. The energy-store elements are then dimensioned differently accordingly. Reciprocating movement in the upward and downward direction is possible here.

Further advantages, features and details of the invention can be gathered from the following description of preferred exemplary embodiments and with reference to the drawing, in which.

Figure 1:
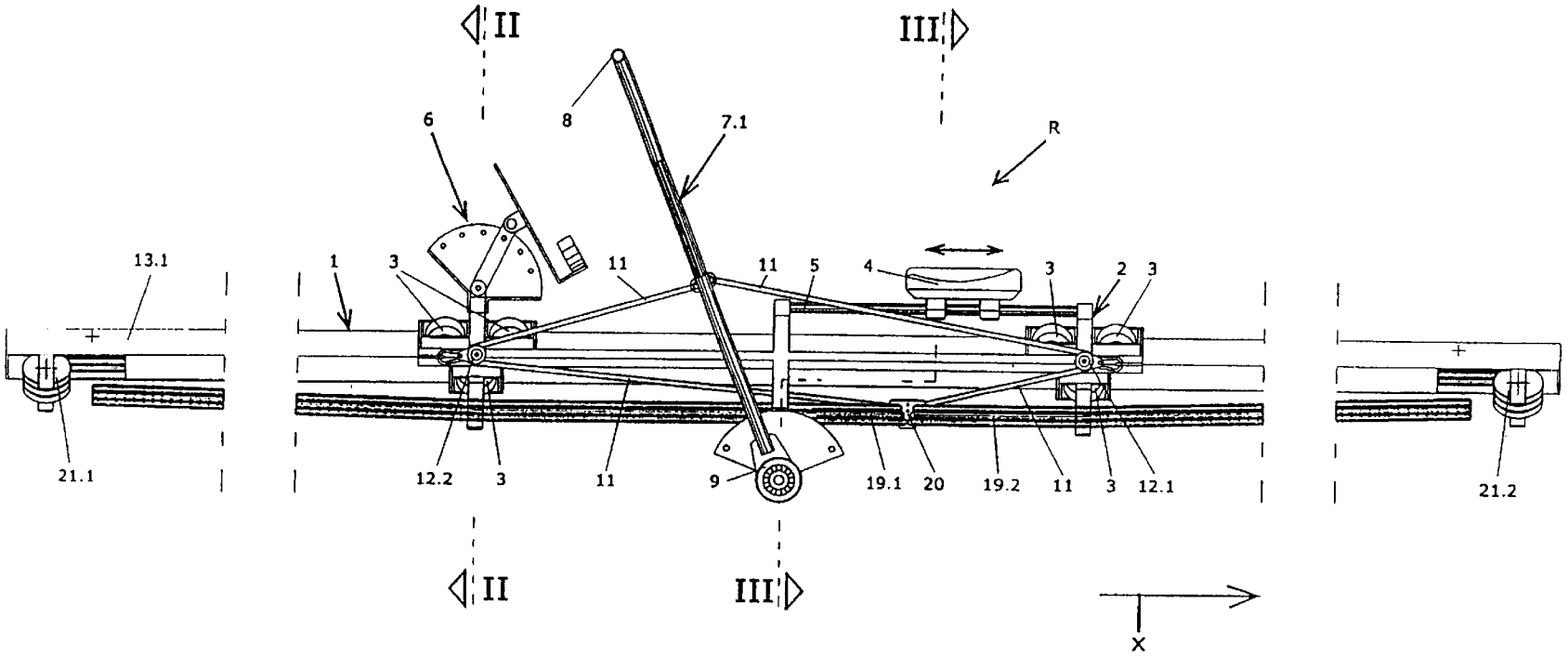
FIG. 1 shows a plan view of a fitness machine according to the invention.

According to FIG. 1, a schematically illustrated fitness machine R has a carrier element 1 on which a carriage 2 is mounted in a displaceable manner. Provided on the end sides of the carriage 2 are a plurality of rollers 3 which mount the carriage 2 in a linearly movable manner on the carrier element 1.

Furthermore, in the preferred exemplary embodiment, the carriage 2 is assigned a seat element 4 which is mounted such that it can be displaced back and forth in relation to the carriage 2 on crossmembers 5, as is illustrated in the double-arrow direction.

The carriage 2 is assigned, on the end side, a mounting arrangement 6 in which a person's feet can be positioned. Said mounting arrangement 6 is designed such that it can be pivoted and, if appropriate, vertically adjusted in the known manner. Stirrups or straps (not illustrated) are likewise provided here in order to secure, for example, a foot thereon. This can take place, for example, by means of conventional touch-and-close strips or the like.

Figure 3:
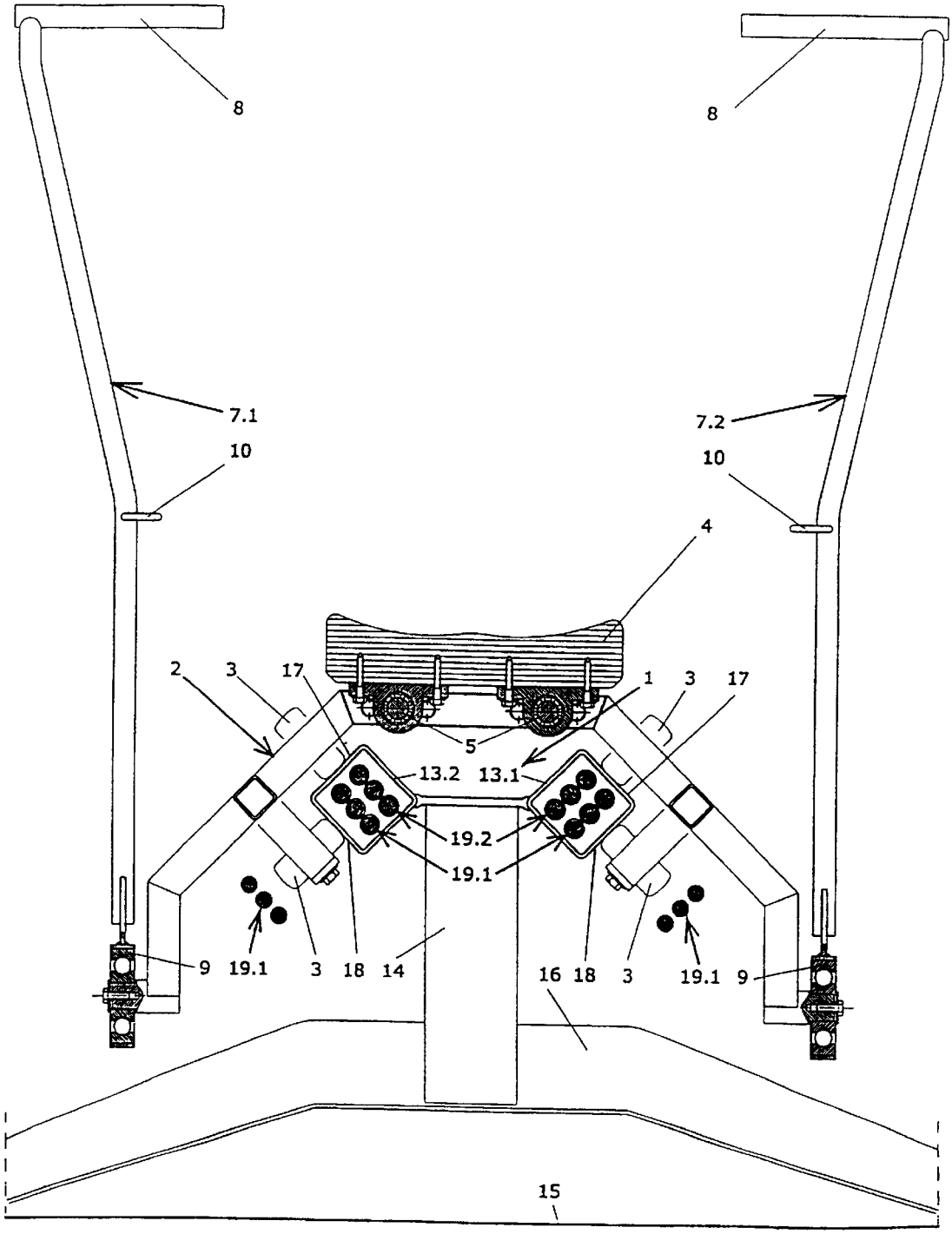
FIG. 3 shows a schematically illustrated cross section through the fitness machine according to FIG. 1 along line III—III.

The carriage 2 is assigned, laterally, actuating elements 7.1, 7.2, see also FIG. 3, which are connected pivotably to the carriage 2. In this case, the actuating element 7.1, 7.2 allows a pivoting movement about its bearing 9 by means of handle elements 8, which are preferably aligned inward.

The actuating element 7.1, 7.2 also has an accommodating eyelet 10 which serves for securing and accommodating a flexible tie element 11. The carriage 2 is also assigned, on the end sides, deflecting elements 12.1, 12.2 at which the tie elements 11, starting from the actuating element 7.1, 7.2, are deflected. The deflection is discussed in more detail hereinbelow.

Figure 2:
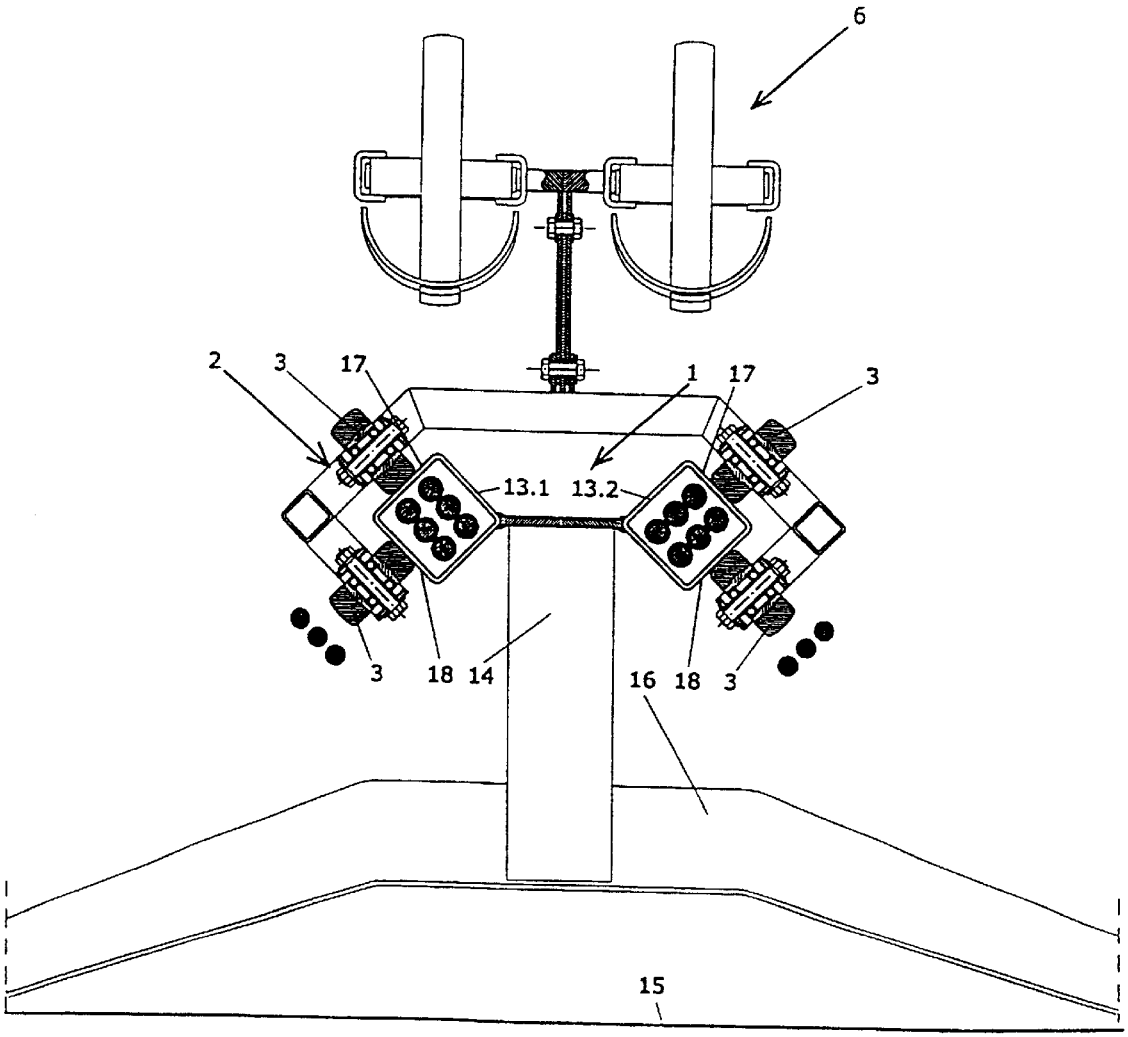
FIG. 2 shows a schematically illustrated cross section through the fitness machine according to FIG. 1 along line II—II.

As can also be gathered from FIG. 2, the carrier element 1 essentially comprises two mutually parallel guide rails 13.1, 13.2 which, in lozenge form on a strut 14, are spaced apart from an underlying surface 15 or floor. It is possible for the strut 14 to be connected directly to the underlying surface 15 or to terminate at a carrying panel 16 and support the fitness machine R.

As is illustrated, in particular in FIGS. 2 and 3, rollers 3 of the carriage 2 rest on top surfaces 17 of the guide rail 13, which are of angled design as a result of the diagonal arrangement of the carrier element, in particular of the guide rails 13.1., 13.2.

Butting against bottom surfaces 18 are further rollers 3, which are mounted via carrying arms (not designated here) of the carriage 2. It may thus be ensured that the carriage 2 runs on the carrier element 1 along a specific fixed track. Only a linear movement along the carrier element 1 is possible.

The situations where the carriage 2 lifts off and possibly slides laterally are ruled out here.

The scope of the present invention, however, is also intended to include other profiles in order to guide, for example, a carriage 2 linearly along a carrier element 1. A large number of possibilities to this end are given in the prior art.

The essential factor in the present invention, however, is that the carriage 2, on the carrier element 1, can be made to reciprocate back and forth out of a rest position, which is preferably set centrally on the carrier element 1, by actuation of the actuating element 7.1, 7.2. The carriage 2 is made to move in a reciprocating manner in this way in relation to the carrier element 1 by deflection of the actuating element 7.1., 7.2.

As a result, at least one energy-store element 19.1, 19.2, which is coupled to the actuating element 7.1., 7.2 via the flexible tie element 11, is deflected correspondingly. In this case, the tie elements 11 of the actuating element 7.1, 7.2 act on the carriage 2 via deflecting arrangements 12.1, 12.2 and lead to a force-transmitting element 20. The force-transmitting element 20 is secured on the two energy-store elements 19.1, 19.2. It is fixed to the energy-store elements 19.1, 19.2, the two tie elements 11 being secured there.

The energy-store elements 19.1, 19.2, which are prestressed in a rest position, are deflected via deflecting elements 21.1, 21.2 and guided into the interior of the carrier element 1, in particular into the interior of the guide rails 13.1, 13.2. Following the deflection at the deflecting elements 21.1, 21.2 (only schematically illustrated here), said energy-store elements run through the guide rails 13.1 in their entirety. On the end sides, the energy-store elements are secured on the inside, as is not illustrated here, on the guide rails 13.1, 13.2.

As can be seen, in particular, from FIG. 3, the energy-store elements 19.1, 19.2 are mounted within the guide rails 13.1, 13.2. The energy-store elements 19.1, 19.2 may be designed, singly or multiply, as elastic rubber elements.

It is also intended to lie within the scope of the present invention, however, to be able to use and provide here other energy-store elements which allow a corresponding reciprocating movement of the carriage 2 on the carrier element 1. It is also possible for spring elements and/or weights or the like, as energy-store elements 19.1, 19.2, to allow a corresponding movement.

Figure 4A:
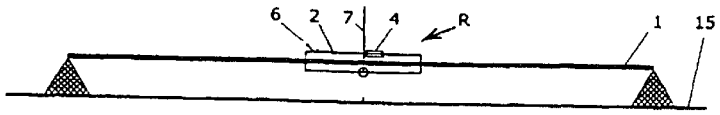
FIGS. 4*a* to 4*k* show schematically illustrated functional sequences of the fitness machine in the different rest, use and reciprocating positions.

The present invention functions as follows:

FIG. 4*a* illustrates a rest position of the apparatus R, in which the carriage 2 is arranged approximately centrally on the carrier element 1. The energy-store elements 19.1, 19.2 (not illustrated here) are both prestressed approximately uniformly.

Figure 4B:
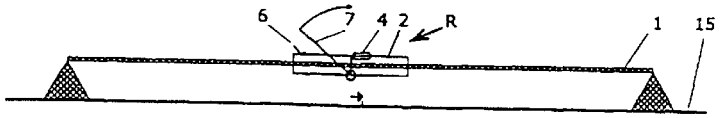

Deflection of the actuating element 7 to the left, as is illustrated in FIG. 4*b*, causes a slight movement or deflection of the carriage 2 counter to the direction of travel X.

Subsequent movements of the actuating element 7 back causes, via the tie elements 11, the energy-store element 19.1, as illustrated in FIG. 1 in particular, to be relieved of loading and the energy-store element 19.2 to be subjected to stressing. A slight deflecting movement, as can be seen from FIG. 4*b,* counter to the direction of travel X takes place.

A subsequent movement of the actuating element 7 in the direction of travel X, if appropriate also by virtue of the seat element 4 being displaced in the direction of travel X on the carriage 2, causes the carriage 2 to move through the rest position and moves the carriage 2 up to a certain turning point, which depends on the mass of the carriage 2 and the speed thereof. A relatively large deflection takes place.

Figure 4C:
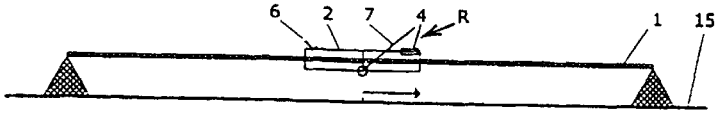
Figure 4D:
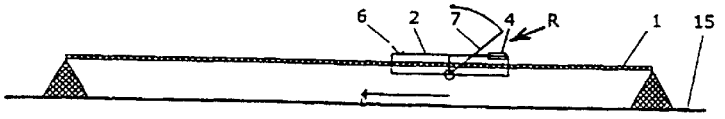
Figure 4E:
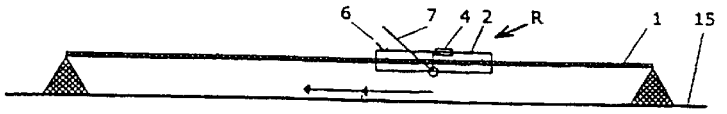

This can be seen, for example, from FIGS. 4*c* and 4*d.* Subsequent movements of the actuating element 7 back counter to the direction of travel X, as is depicted in FIGS. 4*d* and 4*e* in particular, causes the carriage 2 to move back counter to the direction of travel X.

Figure 4F:
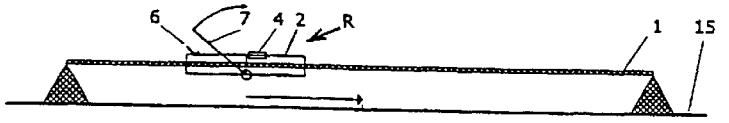
Figure 4G:
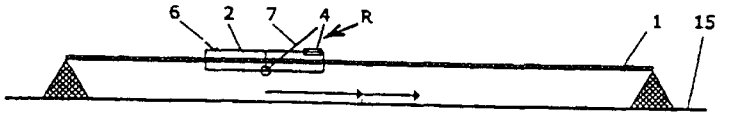
Figure 4H:
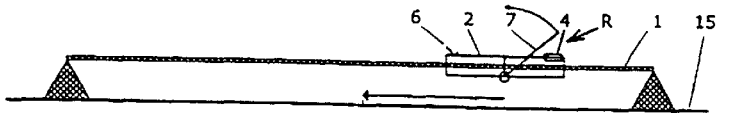

In this case, the carriage 2 runs through the rest position at a high speed and is accelerated on the carrier element 1 counter to the direction of travel X until the restoring moments and/or restoring forces of the energy-store elements 19.2 are sufficient to brake this movement and, by additional actuation of the actuating element 7 in the direction of travel X, as is illustrated in FIGS. 4*f* and 4*g* in particular, to move the carriage 2 again through the rest position at high speed. The assistance of the acceleration of the carriage 2 and the actuating element 7 cause a deflection on the carrier element 1, as is depicted, for example, in FIG. 4*h.*

Figure 4I:
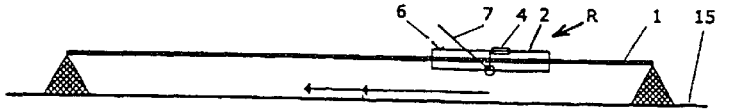
Figure 4J:
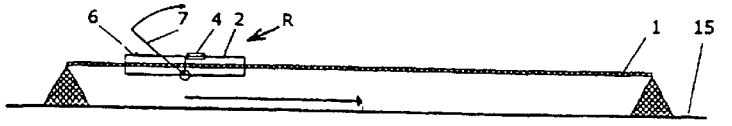
Figure 4K:
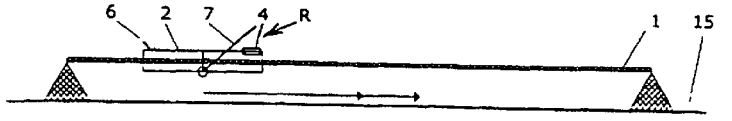

Then, as has been described above, the actuating element 7 is moved back counter to the direction of travel X, the carriage 2 being accelerated through the rest position into a further deflected position, in particular end position, as is illustrated in FIGS. 4*i* and 4*j* in particular. A subsequent movement of the actuating element 7 in the direction of travel X accelerates the carriage 2 again in the direction of travel X according to FIG. 4*k.*

If these end positions are reached, as are illustrated, for example, in FIGS. 4*f,* 4*h* and 4*j,* then the energy-store elements 19.1 and 19.2 are each either subjected to stressing or relieved of stressing. In the preferably central rest position, the two energy-store elements 19.1, 19.2 are prestressed uniformly, with the result that maximum deflection of the carriage 2 can take place without one of the energy-store elements 19.1, 19.2 sagging, for example, in relation to the carrier element 1.

It is also intended to lie within the scope of the present invention, however, that, for example, the carrier element 1 can run in a curved manner over the underlying surface 15, with the result that a reciprocating movement follows the contour of the carrier element 1. It should also be conceivable, if appropriate, for the carrier element 1 to be arranged, if appropriate obliquely or even in undulating form, in different vertical positions above the underlying surface 15, in order also to allow reciprocating movement in different vertical positions, for example hollows or the like. A vertical position of the carrier element 1 in relation to the underlying surface 15 is likewise conceivable here. The corresponding energy-store elements are then guided, if appropriate via deflecting and retaining rollers, such that they can be moved in accordance with the profile of the carrier element 1 and are made to be of larger or smaller dimensions.

What is claimed is:

1. A fitness machine intended for at least one person, comprising:

a carriage mounted in a movable manner on a carrier element;

at least one actuating element arranged on the carriage; and at least one energy-store element having a rest position, wherein, by virtue of at least one energy-store element being subjected to an action of said actuating element said carriage can be accelerated into a reciprocating movement, caused by said at least one energy-store element about said rest position.

2. The fitness machine as claimed in claim 1, wherein the energy-store element comprises at least one part and may be assigned in a rereleasable manner a force-transmitting element for the purpose of transmitting forces.

3. The fitness machine as claimed in claim 2, wherein the force-transmitting element is connected to the carriage and/or to the actuating element.

4. The fitness machine as claimed in claim 2, wherein the actuating element can be moved in and/or counter to a direction of travel, the actuating element being connected directly or indirectly to the carriage and/or the energy-store element and to the force-transmitting element.

5. The fitness machine as claimed in claim 1, wherein the carrier element is formed from at least one guide rail.

6. The fitness machine as claimed in claim 5, wherein each of said at least one guide rails is assigned on a first and second side of said at least one guide rails, a plurality of deflecting elements for the at least one energy-store elements.

7. The fitness machine as claimed in claim 6, wherein the at least one energy-store element is deflected at one of said plurality of deflecting elements, guided through at least one of said guide rails and secured on one of said sides.

8. The fitness machine as claimed in claim 2, wherein the carriage is assigned, on the end side in each case, deflecting arrangements which each produce a connection between the actuating element and force-transmitting element directly or indirectly, if appropriate via a flexible tie element, in particular wire or line.

9. The fitness machine as claimed in claim 1, wherein the carriage is assigned, in a fixed and/or displaceable manner, at least one seat element or at least one mounting arrangement.

10. The fitness machine as claimed in claim 2, wherein the carriage and/or force-transmitting element, in a rest position, are/is arranged approximately centrally on a carrier element, and the carriage can be accelerated in or counter to a direction of travel by virtue of the actuating element being deflected.

11. The fitness machine as claimed in claim 10, wherein, in a deflected end position, one energy-store element is relieved of stressing and the other energy-store element is subjected to stressing.

12. The fitness machine as claimed in claim 1, wherein the energy-store element is formed from a plurality of elastic rubber elements.

13. The fitness machine as claimed in claim 1, wherein the carriage can be made to move in a reciprocating manner about a rest position, between two end positions.

14. The fitness machine as claimed in claim 15, wherein the carrier element is arranged in a horizontal to a vertical position in relation to the underlying surface.

15. The fitness machine as claimed in claim 1, wherein the carrier element is formed from at least one guide rail or two mutually parallel guide rails which run in a linear or curved manner and are spaced apart differently in a vertical direction in relation to an underlying surface via a plurality of struts.

* * * * *